US005997940A

United States Patent [19]

Delvinquier et al.

[11] Patent Number: 5,997,940

[45] **Date of Patent: *Dec. 7, 1999**

[54] METHOD FOR PROTECTING POROUS COMPONENTS SUBJECTED TO LARGE POTENTIAL DIFFERENCES AND COMPONENTS THUS PRODUCED

[75] Inventors: Jean-Pierre Delvinquier, Les Ulis; Christian Girardet, Arcueil, both of France

[73] Assignee: Thomson-CSF, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,448

[22] Filed: Sep. 3, 1997

Related U.S. Application Data

[63] Continuation of application No. 08/619,527, Apr. 30, 1996, abandoned.

[30] Foreign Application Priority Data

Aug. 30, 1994 [FR] France ..... 94 10410

[51] Int. Cl.[6] ..... B05D 5/12

[52] U.S. Cl. ..... 427/81; 427/101; 427/294; 29/25.03; 29/25.41; 29/610.1

[58] Field of Search ..... 427/79, 81, 100, 427/101, 294, 443.2, 314, 384; 29/25.03, 25.23, 25.42, 610.1

[56] References Cited

U.S. PATENT DOCUMENTS

| | | | |
|---|---|---|---|
| 3,724,043 | 4/1973 | Eustance | 29/25.42 |
| 4,122,211 | 10/1978 | Kikuga et al. | 427/58 |
| 4,882,455 | 11/1989 | Sato et al. | 174/68.5 |
| 5,167,715 | 12/1992 | Kalafala et al. | 118/712 |

*Primary Examiner*—Brian K. Talbot
*Attorney, Agent, or Firm*—Oblon, Spivak, McClelland, Maier, & Neustadt, P.C.

[57] ABSTRACT

A method for protecting porous components immersed in insulating liquid and subjected to high voltage. The method involves impregnating the components in a heated bath of polymerisable fluid resin wherein the polymerization occurs after the fluid resin penetrates the pores of the porous components.

2 Claims, 1 Drawing Sheet

METHOD FOR PROTECTING POROUS COMPONENTS SUBJECTED TO LARGE POTENTIAL DIFFERENCES AND COMPONENTS THUS PRODUCED

This application of 08/619,527, filed Apr. 30, 1996, now abandoned, which is a 371 of PCT/FR95/01129, filed Aug. 29, 1995.

BACKGROUND OF THE INVENTION

1. Field of the Invention

The present invention relates to a method for protecting porous components subjected to large potential differences and to the components thus produced.

2. Description of the Related Art

Numerous electronic devices employing high voltages use elaborate components based on porous materials, for example ceramics. These materials can therefore absorb low-viscosity fluids by capillary action.

The overall electrical insulation of the electronic device is conventionally ensured using a dielectric fluid, for example a mineral oil; this fluid can penetrate the pores of the material. If the component is subjected to a large potential difference applied in a very short time, the dielectric fluid present in the cavities of the porous material may be partially destroyed and release conductive carbon-containing particles. The local damage can then extend and result in short-circuiting of the component, which immediately leads to its complete destruction. Another possibility of damage exists if the dielectric fluid can release gas bubbles under the effect of an electric field (the so-called "degassing" phenomenon). In this case, a gas bubble created in a microcavity can generate a high stress on the walls of the cavity and crack the material, which also leads to destruction of the component.

SUMMARY OF THE INVENTION

The subject of the present invention is a method for durable protection against electric breakdown with minimal Joule losses, of porous components immersed in an insulating fluid, it being necessary for the protection products to be compatible with the insulating fluid at temperatures which may be as high as approximately 150° C., which makes it possible, when these components are subjected to large potential differences and/or to repeated electric discharges at high voltage, to avoid their destruction, which method is easy to implement and ensures long-term protection.

A further subject of the present invention is components including a porous part which are protected against destruction when they are subjected to large potential differences and whose cost price is not excessively increased by such protection.

The method according to the invention consists in fully impregnating the porous components to be protected in a hot bath of polymerisable fluid resin, which is polymerised after penetrating the pores of these components.

The porous components protected according to the invention have their pores filled with polymerised resin.

BRIEF DESCRIPTION OF THE DRAWINGS

The present invention will be better understood on reading the detailed description of an embodiment, taken by way of nonlimiting example and illustrated by the appended drawing, in which.

DETAILED DESCRIPTION OF THE INVENTION

Figure 1:
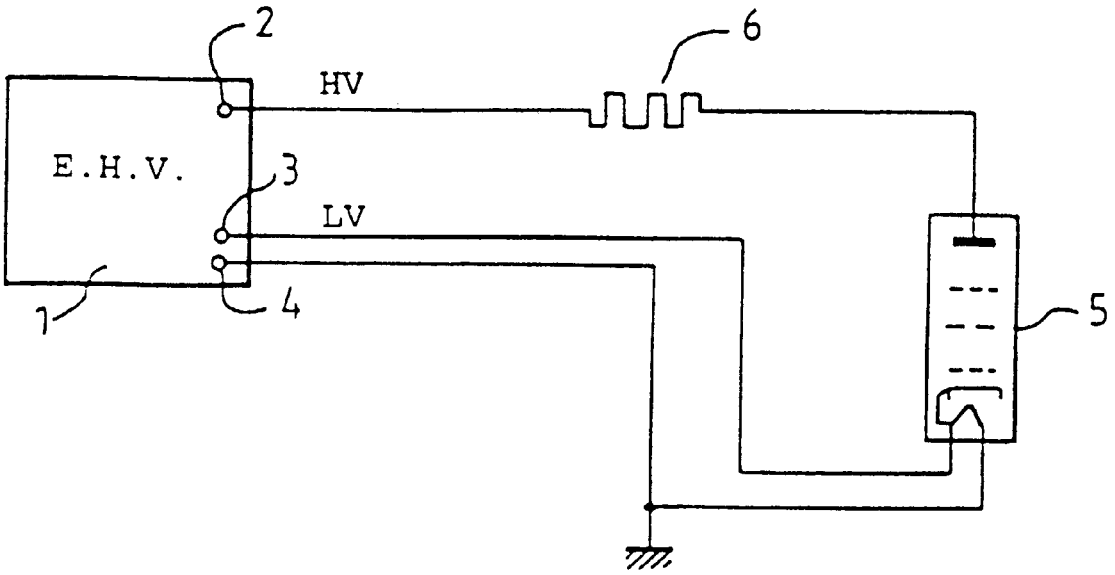
FIG. 1 is the simplified block diagram of a high-voltage apparatus including a porous-substrate resistor which is to be protected against breakdown.

FIG. 1 represents the simplified diagram of an example of a high-voltage circuit including a porous component. The circuit in FIG. 1 includes: a generator 1 including a high-voltage output 2 which produces, relative to the earth, a high voltage HV, for example of 40 kV. The generator 1 also includes two outputs 3, 4 (the output 4 being grounded) between which a low voltage LV appears, this low voltage supplying the filament of an electron tube 5 (for example an output amplifier tube of a radio transmitter), the cathode of which is grounded and the anode of which is connected to the output 2 through a resistor 6 immersed in an organic or mineral oil. This resistor 6 has low resistance (for example a few tens of ohms) and is noninductive. It must be capable of absorbing the discharge energy of the capacitive elements of the generator 1 (this energy may be 50 to 100 joules). If electric arcs are produced in the tube 5, the high voltage is transferred to the terminals of the resistor 6 and the instantaneous current flowing through it may then reach 1000 A.

The material commonly employed for producing the resistor 6 is a weakly conductive ceramic made from finely ground mineral elements which are mixed and are fired at high temperature to form a slightly porous solid having excellent resistance to electrical and thermal stresses.

According to known methods, the protection conventionally employed against the penetration of dielectric fluids into porous components consists of a protective coating deposited on the surface.

This coating may be a paint, a varnish or a coating resin. The coating material must constitute a leaktight film without any discontinuity and be capable of tolerating, without damage, the prolonged period in the dielectric fluid under the operating conditions of the equipment (pressure, temperature, vibrations, etc.) and possible mechanical degradation (scratches). This coating must adhere perfectly to the various supports: (porous material constituting the body of the component, electrical connections, fastenings, etc.).

Furthermore, the coating must have a high surface resistivity, so that no significant leakage currents occur within it.

This set of requirements makes the ideal material difficult to find, and experiments show that this coating is a critical point which limits the voltage strength performance of the component.

Figure 2:
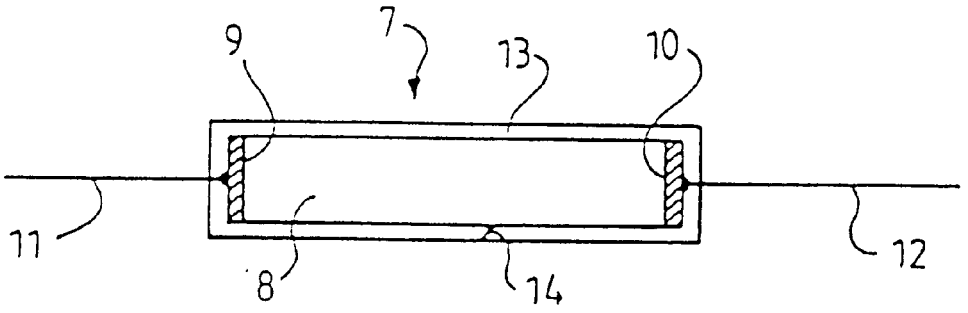
FIG. 2 PRIOR ART
FIG. 2 is a simplified sectional view of a porous-substrate component protected according to a method of the prior art.

FIG. 2 schematically represents, in section, a resistor 7 thus treated. This resistor 7 includes a porous ceramic body 8 and two connection electrodes 9, 10 with their connection wires 11, 12. The aforementioned treatment results in the formation of an outer protective layer 13 on the resistor 7, with the exception, of course, of the wires 11, 12 which are left uncovered. If, for example, a crack, a scratch or a puncture of the layer 13 occurs at a point 14 on this layer, the insulating oil in which this resistor 17 is immersed will pass through this layer 13 and penetrate the pores of the resistor, which may lead to its destruction, in the manner described above.

Another solution consists in the use of a high-performance dielectric fluid which has a greater dielectric strength and does not release gases under the effect of electric discharges. This solution excludes many conventional, and therefore inexpensive, fluids and makes it necessary to use synthetic compounds (silicone oil, perfluoro fluids, etc.) which are much more expensive and generally denser than the traditional mineral oils, which rules out their use in aircraft on-board equipment.

According to the invention, in order permanently to prevent any possibility of penetration of the dielectric fluid, the proposed method consists in complete impregnation of the porous material using a highly fluid resin which is polymerised in a second step in order to obtain a solid dielectric. This solid dielectric therefore occupies all the cavities and pores of the material, and penetration by the dielectric fluid is made impossible.

In order to guarantee perfect penetration of the impregnation resin, it is necessary to adhere to the usual rules of the art for this type of operation, and the procedure is preferably as follows:

A highly fluid resin with low surface tension is chosen, for example an epoxide impregnation system, but other types of resins are applicable. The resin must have high performance as regards its dielectric properties and be compatible with the dielectric fluid used (no dissolving, no degradation of the resin or of the fluid).

The component to be impregnated is carefully degreased by soaking in a bath of solvent of the trichloroethane type, or equivalent, preferably with the application of ultrasound.

The component is heated in order to eliminate the solvent and moisture from it, under air vacuum (approximately 10 mbar or better, for example). This heating takes place at a temperature of between approximately 90° C. and 120° C., for approximately 8 h to 4 days.

Those parts of the component which are not to be covered are protected (for example, for a resistor, the connection wires, such as the aforementioned wires 11 and 12), using a peelable varnish.

The impregnation resin is preheated to the temperature at which it acquires the desired viscosity (in order to be able to penetrate the pores of the component). This temperature is, for example, approximately 60° C. This preheating takes place under vacuum (approximately 10 mbar or better) and makes it possible to eliminate the air enclosed in the resin. When hot, the resin preferably has a viscosity of less than or equal to 0.5 Pa.s and, when cold, a dielectric strength of a least 5 kV/mm.

The component to be impregnated is immersed in the resin bath thus preheated, while maintaining its temperature at the value reached at the end of preheating (60° C. for the above example), and the whole is degassed under vacuum (approximately 10 mbar or better) until all of the air enclosed in the pores of the component has been eliminated. This step may, for example, last approximately 10 to 30 mins. In general, it lasts for as long as air bubbles are observed to rise to the surface of the resin bath.

The impregnation is completed by placing the resin bath in which the component is immersed under high pressure (for example, approximately 20 bar). The temperature of the bath can then be raised to a temperature slightly above that which it had during the degassing of the component, for example 80 to 90° C. for a degassing temperature of approximately 60° C. This step may last, for example, approximately 2 to 4 hours. It is necessary, in particular, for treating components having small pore size (for example, pores with diameter less than 50 $\mu$m).

Finally, the component is removed from the bath and drained, the streaks are wiped off and the resin is hot-polymerised according to the specifications of the supplier (for example at approximately 90° C. for 4 hours).

Of course, it is possible to impregnate a plurality of components simultaneously in the same bath, if they can be accommodated therein. The component mentioned above is a resistor, but it is clearly possible to treat other components which include a porous substrate or part, such as, for example, capacitors or windings. The support may be made of ceramic or of ferrite, for example.

The above-described method was tested with a "Scotchcast 280" epoxy resin from the Company 3M on carbon-filled ceramic resistors. Of course, numerous other resins may be suitable. The conditions which they must fulfil are that they are inert with respect to the conventional solvents and the oil of the bath in which the components are immersed in normal use, have a high hot viscosity of less than or equal to 0.5 Pa.s and a dielectric strength, at the operating temperature, of at least 5 kV/mm.

The voltage strength of these resistors, immersed in a mineral or organic oil bath, is excellent and is maintained after a number of uses (capacitive discharges) of greater than 1000 at the maximum applicable voltage, whereas these same resistors, when not impregnated and when used under the same conditions, are destroyed very rapidly (approximately 10 discharges).

Consequently, for components such as porous-substrate resistors, the method of the invention makes it possible, as compared with the known methods and for the same voltage, to increase their life considerably, or else, for the same life, to increase the voltage applied to these components, and/or to use a bath of ordinary oil instead of a very expensive high-quality oil.

It is claimed:

1. A method for protecting a porous high voltage electrical energy absorbing component from contamination by an insulating fluid in which said component is to be immersed, comprising the steps of:

heating the component under vacuum to eliminate solvent and moisture therefrom;

providing a low viscosity fluid resin bath compatible with said insulating fluid;

preheating said resin bath under vacuum to a temperature wherein the low viscosity of said resin bath provides for penetration of pores of said porous component;

immersing said porous component in said heated resin bath;

keeping the component immersed in said heated resin bath under vacuum until the porous component is entirely degassed;

completing impregnation of pores of said porous component in said heated resin bath by increasing pressure on said porous component in said heated resin bath;

removing said porous component from said heated resin bath;

hot-polymerising resin retained in the porous component in order to obtain a solid dielectric which occupies all pores of the porous component; and inserting said component into said insulating fluid which cannot penetrate the component.

2. Method according to claim 1, characterized in that the viscosity of said heated resin is less than or equal to approximately 0.5 Pa.s.

* * * * *